United States Patent [19]

Schneider

[11] 4,419,283

[45] Dec. 6, 1983

[54] LIQUID COMPOSITIONS FOR DISPLAY DEVICES

[76] Inventor: Ronald A. Schneider, 555 Pierce St., #303, Albany, Calif. 94706

[21] Appl. No.: 284,622

[22] Filed: Jul. 20, 1981

Related U.S. Application Data

[63] Continuation-in-part of Ser. No. 105,967, Dec. 21, 1979, abandoned, and Ser. No. 105,966, Dec. 21, 1979, abandoned.

[51] Int. Cl.[3] ..... G09F 19/00

[52] U.S. Cl. ..... 252/600; 40/406; 40/407; 40/427; 272/8 D; 272/8 P

[58] Field of Search ..... 252/600; 40/406, 407, 40/427; 272/8 D, 8 P

[56] References Cited

U.S. PATENT DOCUMENTS

| | | | |
|---|---|---|---|
| 1,979,336 | 11/1934 | Martin et al. | 40/406 |
| 2,054,275 | 9/1936 | Vellner | 40/406 |
| 2,162,897 | 6/1939 | Rosenblatt | 40/406 |
| 3,058,245 | 10/1962 | Pietors | 40/406 |
| 3,387,396 | 6/1968 | Smith | 40/406 |
| 3,564,740 | 2/1971 | Calfee | 40/406 |
| 3,570,156 | 3/1971 | Walker | 40/406 |
| 3,613,264 | 10/1971 | Vitka et al. | 35/19 R |
| 3,629,958 | 12/1971 | Olson | 35/19 R |
| 3,738,036 | 6/1973 | Landsinger et al. | 40/406 |
| 3,843,244 | 10/1974 | Facchini | 353/2 |
| 3,973,340 | 7/1977 | Ball | 40/406 |
| 4,034,493 | 7/1977 | Ball | 40/406 |
| 4,057,921 | 11/1977 | Ball | 40/406 |
| 4,085,533 | 4/1978 | Ewald | 40/406 |

FOREIGN PATENT DOCUMENTS

| | | | |
|---|---|---|---|
| 1368241 | 9/1974 | United Kingdom | 40/406 |

OTHER PUBLICATIONS

Handbook of Chemistry & Physics, The Chemical Rubber Co., Cleveland, Ohio, 50th Edition, p. C-720.

*Primary Examiner*—Maurice J. Welsh

[57] ABSTRACT

Systems of three, four, and five mutually immiscible liquid phases suitable for use in display devices. Preferred four phase systems comprise one highly hydrophobic organic phase, one organic phase containing compounds which are moderately polar, one phase containing hydrogen-bonding organic compounds, and one aqueous phase. Systems can be multicolored, not toxic, not combustible, and not corrosive to plastic.

28 Claims, No Drawings

LIQUID COMPOSITIONS FOR DISPLAY DEVICES

CROSS-REFERENCE TO RELATED APPLICATIONS

This application is a continuation-in-part of U.S. application Ser. No. 105,967, filed Dec. 21, 1979, and U.S. application Ser. No. 105,966, filed Dec. 21, 1979 both of which are now abandoned.

BACKGROUND OF THE INVENTION

This invention relates to compositions of liquids employed in display devices wherein the movement of a plurality of mutually immiscible liquids is important in the normal operation of the device. More particularly, it relates to such compositions wherein the number of mutually immiscible liquids is three or more.

Mutually immiscible liquids are those which after intimate mixing with every other liquid phase of the system maintain separate liquid phases at equilibrium. No matter how thoroughly the liquids are mixed, they will always separate into the same number of layers on standing.

A large number of display devices are known which depend on the movement of two mutually immiscible liquids. Generally, the liquids are colored and contained in a transparent container. Examples of such devices can be found in U.S. Pat. Nos. 1,979,336; 2,054,275; 2,162,897; 3,058,245; 3,387,396; 3,564,740; 3,570,156; 3,613,264; 3,629,958; 3,738,036; 3,843,244; 3,973,340; 4,034,493; and 4,057,921, none of which gives an example using more than two mutually immiscible liquids or teaches how such could be achieved.

One example of a system of three liquid layers can be found in U.S. Pat. No. 3,629,958, which describes a composition of diisobutyl adipate, water, and dimethyl phthalate for use in a visual device to simulate wave motion. However, although the top layer is immiscible with the middle one and the bottom layer is immiscible with the middle one, the top layer is not immiscible with the bottom one. Thus this device maintains three layers as long as the top layer never contacts the bottom one, but upon vigorous shaking, only two layers remain.

The only known examples of use in display devices of three or more mutually immiscible liquids are found in U.S. Pat. No. 4,085,533. All the liquid systems described therein, however, suffer from problems of dyeability and compatibility with preferred plastic containers.

All the systems of four or more mutually immiscible liquids described in U.S. Pat. No. 4,085,533 comprise at least one liquid composed primarily of highly fluorinated organic compounds. It is well known that highly fluorinated organic compounds tend to be immiscible with almost everything else, and thus add additional phases to any system to which they are added. Unfortunately, this immiscibility extends to essentially all conventional dyes. Therefore, fluorinated layers cannot be colored with conventional dyes, or by any other inexpensive and satisfactory method. They must remain colorless. No system has heretofore been known of four mutually immiscible liquids each of which can be dyed a color different from that of any of the other three.

All the three-phase systems which do not contain fluorine disclosed in U.S. Pat. No. 4,085,533 attack thermoplastics which are preferred for construction of the devices described below. It would be highly desirable to have a three-phase system which preserves the integrity of the walls in a preferred device and still be dyeable with conventional dyes.

To be suitable for making an inexpensive consumer device such as a child's toy, the liquids should be inexpensive, not toxic, not combustible, easy to dye different colors, and liquid throughout the range of normal room temperatures and pressures. Most inorganic liquids, such as antimony pentachloride and titanium tetrachloride, are toxic and corrosive. Others are liquid only above room temperature. What are needed are room temperature, mutually immiscible liquid systems of water and inexpensive, not toxic, not combustible, readily dyeable organic compounds compatible with optical plastics.

Since satisfactory systems have apparently not been known, many devices, as in U.S. Pat. No. 4,057,921, in order to achieve multiple colors use multiple chambers or compartments wherein the liquid or pair of liquids in each is isolated from that in all the others.

The visual impact and interest generating capacity of mutually immiscible liquid systems within any given compartment goes up sharply as the number of immiscible liquids is increased. A system of three immiscible liquids is for most applications in display devices far superior to only two. Often, in fact, its effects are qualitatively different from those achievable with only two, in the same way that effects from two liquids can be qualitatively different from those from only one.

One object of the present invention is to provide novel compositions of three and of four mutually immiscible liquids suitable for use in consumer items, especially toys.

Another object is to make possible improved visual display devices.

Another object is to provide liquid mixtures capable of producing color patterns and movements beyond the capability of known mixtures.

Another object is to provide compositions which will make possible novel art forms and toys.

A further object is to provide multi-phase liquid systems which are inexpensive, not toxic, not combustible, not corrosive to plastic, and easy to dye different colors.

Other objects and advantages of the invention will be apparent from the following description.

SUMMARY OF THE INVENTION

The present invention provides novel compositions which make possible a greater number of mutually immiscible liquid phases than have been practical in devices up to now. It provides novel systems of three, four, and five mutually immiscible liquids, and it provides systems of liquids which are not toxic and not combustible, do not attack poly(vinyl chloride), polycarbonate, nitrile, and acrylic resins, and are relatively easy to dye different pure colors. It makes possible improved visual display devices. One of the principal uses contemplated for this invention is in visual toys, especially in novel toys werein three mutually immiscible liquid phases are sealed between two substantially parallel, transparent, flexible sheets of thermoplastic.

Systems of three liquid phases are unusual and not easy for the average chemist without experience in this area to produce. They are almost never encountered in everyday life and tend to be laboratory curiousities. Indeed, the normal expectation is that whenever a number of different organic and aqueous liquids are mixed, there will be at most two phases, an oil phase and a water phase.

Even patents which allege that more than two mutually immiscible liquids may be used often implicity assume the contrary throughout the rest of the decription. U.S. Pat. No. 3,058,245 states "It is furthermore possible to successively pass two or more liquids of different colours, immiscibly [sic] in one another, through the conduits, e.g. solutions of dyes which are insoluble in the other solution." Although the author stated that use of more than two immiscible liquids is possible, he clearly did not seriously contemplate use of more than two or he would have said "insoluble in the other solutions."

While achieving three phases is difficult, achieving four mutually immiscible liquid phases using inexpensive, not toxic, not combustible, readily dyeable, readily available substances is vastly more difficult. Considerable experimentation was required before even the first such system was discovered. Nevertheless, eventually a relatively large number of four-phase systems was worked out, not all of which are not toxic or not combustible.

Common to all these new four-phase systems is one highly hydrophobic organic phase, one organic phase containing compounds which are moderately polar, one phase containing hydrogen-bonding organic compounds, and one aqueous phase. Classes of compounds suitable for making each of these phases will be discussed in more detail below.

Let a substance which becomes a principal constituent of the highly hydrophobic phase be designated a member of Group A while substances forming the other phases will be known as members of Groups B, C, or D respectively. The Examples provide a large number of examples of compounds typical of Groups A, B, C, and D.

In general, a four phase system may be generated by mixing approximately equal volumes of four liquids each composed largely of substances from a different one of the four Groups.

The numerous variables that determine whether four phases will form are so subtle that selection of suitable substances is best done by extrapolation or analogy from the examples. Some categorization of the various classes of suitable compounds is presented below.

Not every combination of substances selected from each of the four Groups in the examples will always form four phases. Nevertheless, with a little variation of conditions or materials four phases can generally be formed by applying the principles of solution chemistry as shown in the following examples.

In examples 56 and 62, dimethyl phthalate and benzonitrile formed four phases, but with the Group A, C, and D liquids of examples 27–55, they only formed three. If 2 mL of dimethyl phthalate is used under the latter conditions with 2 mL of each of the other components, the volumes of the resulting three layers from top to bottom are 1.8, 5.1 and 1.1 mL. By adding a hydrocarbon soluble dye, the top layer can be identified as the hydrocarbon while the middle layer is a mixture of Group B and C compounds. If one wants to retain dimethyl phthalate but form four layers, the simplest approach would be to increase the hydrophilic character of the Group C compound, thus decreasing its mutual solubility with dimethyl phthalate. By using 2 mL of a 3:1 by volume mixture of dipropylene glycol and propylene glycol in place of pure dipropylene glycol, four layers with volumes 2.0, 2.6, 1.9, and 1.4 mL from top to bottom are formed, consisting principally of Groups A, C, B, and D respectively as shown by dyeing. With benzonitrile, the result is very similar: 2.0, 1.2, 3.2, and 1.5 mL, Groups A, B, C, and D from top to bottom.

If dibutyl maleate, on the other hand, is combined with the Group A, C, and D liquids of examples 56 and 62, only three phases are formed, volumes 1.9, 2.0, and 4.0 mL from top to bottom. Dyeing shows them to be A, B and (C+D). The Group C mixture is sufficiently hydrophilic to mix with D. Dimethyl phthalate and benzonitrile had decreased that hydrophilic character by dissolving in the C mixture. Dibutyl maleate is apparently not so soluble, so alternatively the Group C composition may be changed from mixed dipropylene glycol-propylene glycol to pure dipropylene glycol to make it less hydrophilic. Two mL each of paraffin oil, dibutyl maleate, dipropylene glycol and 27% ammonium sulfate solution give 2.2, 1.8, 2.8, and 1.2 mL, Groups A, B, C, and D respectively (example 31).

If 50% aqueous potassium carbonate is used as Group D in the above composition in place of ammonium sulfate, only three layers are obtained with volumes 2.1, 4.0, and 1.9 mL representing A, (B+C), and D. Here the problem is that the water is held too tenaciously in the D layer, and not enough dissolves in the C layer leaving it miscible with the B layer. If one wants to use 50% potassium carbonate together with dibutyl maleate, then to form four layers the C layer must be altered back to being more hydrophilic again. If triethylene glycol is used as the C layer, one obtains 2.5, 1.5, 2.5, and 1.4 mL with A, B, C, and D respectively (79).

By using such reasoning and experimentation, not only may each of the substances in the examples be incorporated in four phase systems, but other substances resembling them may be as well.

The phrase "compounds resembling dibutyl maleate" means compounds which are sufficiently similar structurally to dibutyl maleate that theories of physical chemistry would predict solubility properties to be only slightly different. For example, dibutyl fumarate, a geometric isomer, would be expected to work approximately as well. Dibutyl fumarate was not available for testing, but examples 30 and 32 confirm the general principle.

Knowing that diethyl maleate and dibutyl maleate both work makes it obvious that dipropyl maleate, an intermediate homolog, will work although that substance too was not available for testing.

Replacing the double bond of dibutyl maleate with a benzene ring would retain somewhat similar pi electron character but add four carbon atoms; removing four carbons from the alkoxy portion gives diethyl phthalate, which also works (27).

So do dimethyl phthalate and bis(2-methoxyethyl) phthalate (56 and 71), both of which are more hydrophilic than diethyl phthalate and require compensating changes in Group C liquids of the type previously outlined. Going from diethyl to dimethyl phthalate is obviously going in the direction of greater hydrophilic character since aliphatic hydrocarbon portions are diminished and the bulk of the molecule is moderately polar. Going to 2-methoxyethyl increases rather than decreases the aliphatic hydrocarbon portion, but the ether oxygens add hydrophilicity and counterbalance that effect.

Methyl propyl 4-chlorophthalate might be expected to behave something like dimethyl phthalate since the solubility effects of methyl propyl should be virtually the same as diethyl while the halogen substituent should add polarity to the molecule.

Isomers all with the same functional groups almost always resemble each other in solubility, e.g. 30 and 32, 52 and 53, 56 and 41, 77 and 78, 105 and 106; however, optimum compositions may be slightly different in each case.

Mixtures can sometimes be effective ways of tailoring compositions without chemical change. Neither dibutyl phthalate nor diethyl succinate formed four phases with 27% aqueous ammonium sulfate, dipropylene glycol, and paraffin oil. However, a blend of equal volumes of dibutyl phthalate and diethyl succinate did form four phases in that system (39).

Diethyl succinate has such a low $CH/CO_2$ ratio it is difficult to form four phases with it, while dibutyl phthalate is difficult at the other extreme. In the mixture, each tends to counteract the defects of the other. Although mixtures can sometimes be used to advantage, reasonably pure substances without a wide range of chemical structures are preferred. A single compound generally has a wider range of immiscibility than does a mixture of differing structures.

Diethyl succinate formed only three layers with 27% ammonium sulfate, dipropylene glycol, and paraffin oil because it was too soluble in dipropylene glycol, which could be seen by observing the ratio of volumes of phases, 1:2:1 from top to bottom, and by tinting one or more of the starting components. To form four phases by modifying this case, the Group C compound could be one more hydrophilic in order to lessen its compatibility with diethyl succinate. Triethylene glycol might be used for example instead of dipropylene glycol. However, triethylene glycol is too hydrophilic to be compatible with 27% aqueous ammonium sulfate. Selecting an aqueous phase compatible with triethylene glycol, for example 50% aqueous potassium carbonate, and adding equal volumes of diethyl succinate and paraffin oil gives four phases (78).

Dibutyl phthalate formed only three layers with 27% ammonium sulfate, dipropylene glycol, and paraffin oil because it was too soluble in paraffin oil. To form four phases by modifying this case, the Group C compound could be one less hydrophilic and thus more soluble in dibutyl phthalate. A Group C compound dissolved in dibutyl phthalate will tend to lower its compatibility with paraffin oil. Thus 3-methyl-1,5-pentanediol mixed with equal volumes of dibutyl phthalate, paraffin oil, and 50% aqueous potassium carbonate gave four phases (99). In this case 50% potassium carbonate was chosen instead of 27% ammonium sulfate to minimize the amount of water in the Group C compound and thus maximize its solubility in the dibutyl phthalate.

By using reasoning such as this, which is based on well-known physical chemical principles, and by starting with substances resembling those in the examples, it is possible to create a vast number of four phase systems, all of which fall within the scope of this invention.

Not all compounds resembling those in the examples are liquids at room temperature, dimethyl isophthalate for instance. Compounds with melting points above room temperature can still be used provided they are dissolved by the other components of the mixture or are liquified at the desired operating temperature.

Most preferably, the multiphase systems described herein will be used in display devices designated to operate at or near normal room temperature. In such cases, components liquid at normal room temperatures are preferred, and the contents of the devices should preferably be completely liquid and have low vapor pressure at temperatures in the range of most normal human environments, a range from about 0° C. to about 40° C. The temperature at which all the substances in the examples were tested was about 25° C. except for example 151 wherein one of the phases was formed from a solid melting at 48° C. Obviously, similar systems at other temperatures and pressures are equally possible.

Substances with high vapor pressures at the operating temperature are not preferred, unless use is contemplated in a device such as a bubble light wherein vaporization of one of the components is an essential element in the operation of the device.

The proportions in which the Group A, B, C, and D substances are mixed should generally all be about the same (i.e. within about a factor of two) although in most cases considerable variation is possible. Thus in example 100, four phases form when the proportions are 1:4:4:4 or 4:1:4:4 or 4:4:1:4 or 4:4:4:1 by volume.

In most applications, it is desired that all four liquid phases be more or less equally evident. Thus, compositions with a very small relative volume of one phase are not preferred.

Members of Groups A, B, and C are all organic compounds the molecules of which contain at least 3 hydrogen atoms. The smallest number of hydrogen atoms in any organic compound in examples 1–151 is 4 (126).

Group A substances include silicone oil and substances the molecules of which are composed largely of aliphatic hydrocarbon portions.

Silicone oils contain a repeating silicon-oxygen backbone with organic substituents attached to the silicon. Representative examples are shown in examples 1–5. Preferred organic substituents on silicon are alkyl and fluoroalkyl, with methyl being particularly preferred.

All liquid hydrocarbons which are totally aliphatic are members of Group A (for instance, examples 6–11). In addition, Group A includes compounds wherein the majority of the molecule consists of aliphatic hydrocarbon portions but the molecule also includes a more polar functional group the solubility effects of which are dominated by the larger aliphatic portion. If the functional group is itself hydrophobic and not very polar, it might make up almost half the molecule and still be in Group A, as in example 26 where 9 aliphatic methylene groups are joined to a benzene ring. A double bond in an aliphatic hydrocarbon has practically no effect (8, 9, 11, 19).

If the functional group contains an atom other than carbon and hydrogen, such a functional group being referred to herein as a "hetero functional group", about twelve or more aliphatic carbons together with the corresponding hydrogens are generally necessary per hetero functional group, as in examples 16–25.

Preferred Group A substances are hydrocarbons and fatty acid esters. Group A substances containing at least about 8 carbon atoms per molecules are preferred because their immiscibility is generally better and they tend to be less flammable.

Group B substances include organic molecules containing at least one doubly bonded oxygen or triply bonded nitrogen atom and no ether or hydroxyl groups, wherein the ratio of hydrogen atoms to the total number of doubly bonded oxygen and triply bonded nitrogen atoms in the compound is in the range from about 4 to about 14. Representative compounds of this type, selected from the compounds of known structure in the examples, are listed in Table I.

One particularly preferred functional group is the carboxylic ester group, present in a wide range of relatively nontoxic, nonvolatile, stable, and inexpensive compounds. Nitro and nitrile compounds are less preferred because they tend to be more toxic. Aldehydes are not preferred because they tend to be chemically unstable.

Aromatic ketones (e.g. 49) are preferred, but aliphatic ketones and aldehydes often give poor results because they tend to be widely miscible. Aromatic monocarboxylic esters (e.g. 72) generally give better results than aliphatic ones. Aromatics with polar groups tend to have solubility characteristics which make them particularly well suited to Group B. Aromatic molecules contain at least one polyunsaturated ring wherein the electrons are delocalized.

In the case of aliphatic compounds, the total number of doubly bonded oxygen and triply bonded nitrogen atoms should be at least two for best results, since monofunctional aliphatic compounds tend to be widely miscible.

TABLE I

| GROUP B COMPOUNDS WITHOUT ETHER OR HYDROXYL GROUPS | | | |
|---|---|---|---|
| Example Number | Compound | Ratio of H to C=O + N=O + C≡N | Number of C Atoms per Molecule |
| 1 | dimethyl phthalate | 5 | 10 |
| 27 | diethyl phthalate | 7 | 12 |
| 28 | diallyl phthalate | 7 | 14 |
| 30 | diethyl maleate | 6 | 8 |
| 31 | dibutyl maleate | 10 | 12 |
| 32 | diethyl fumarate | 6 | 8 |
| 33 | diethyl oxalate | 5 | 6 |
| 34 | tripropionin | 6.7 | 12 |
| 36 | ethyl benzoylacetate | 6 | 11 |
| 40 | methyl o-chlorobenzoate | 7 | 8 |
| 41 | m-phenylene diacetate | 5 | 10 |
| 42 | pentaerythritol tetra(3-mercaptopropionate) | 7 | 17 |
| 45 | tricresyl phosphate | 7 | 21 |
| 46 | tris(2,3-dichloropropyl) phosphate | 5 | 9 |
| 47 | o-chlorobenzaldehyde | 5 | 7 |
| 48 | 1-acetylnaphthalene | 10 | 12 |
| 49 | dibenzyl ketone | 14 | 15 |
| 50 | o-tolunitrile | 7 | 8 |
| 51 | phenylacetonitrile | 7 | 8 |
| 52 | 1-nitropropane | 7 | 3 |
| 53 | 2-nitropropane | 7 | 3 |
| 54 | nitrobenzene | 5 | 6 |
| 55 | o-nitrotoluene | 7 | 7 |
| 58 | diethyl adipate | 9 | 10 |
| 62 | benzonitrile | 5 | 7 |
| 64 | 4-chlorobutyronitrile | 6 | 4 |
| 65 | ethyl 2-cyanopropionate | 4.5 | 6 |
| 66 | nitroethane | 5 | 2 |
| 70 | butyl benzyl phthalate | 10 | 19 |
| 72 | benzyl benzoate | 12 | 14 |
| 74 | dimethyl glutarate | 6 | 7 |
| 75 | dimethyl succinate | 5 | 6 |
| 76 | diethyl malonate | 6 | 7 |
| 77 | dimethyl adipate | 7 | 8 |
| 78 | diethyl succinate | 7 | 8 |
| 82 | polyester from adipic acid + diethylene glycol | 8 | |
| 99 | dibutyl phthalate | 11 | 16 |

Thus aliphatic polycarboxylic esters in general give better results than aliphatic monocarboxylic esters. Preferred aliphatic polycarboxylic esters have a ratio of hydrogen atoms to carboxyl groups in the range from about 4 to about 12.

Large molecules are preferred over small ones since they tend to be less volatile, less flammable, and less toxic and their immiscibility is generally better. Very small molecules such as acetone, ethyl acetate, and propionic acid tend to be such good solvents and miscible over such wide ranges that formulation of four layers with Groups A, C, and D is either difficult or impossible. A Group B molecule should preferably contain at least about six carbon atoms, and more preferably at least about eight.

Group B substances also include organic molecules containing at least one doubly bonded oxygen or triply bonded nitrogen atom and at least one ether or hydroxyl group, wherein the ratio of hydrogen atoms to the total number of doubly bonded oxygen and triply bonded nitrogen atoms is in the range from about 8 to about 35. Representative compounds of this type, selected from the examples, are listed in Table II.

Preferably, no more than about one ether or hydroxyl group is present per multiply bonded heteroatom. One particularly preferred functional group containing a multiply bonded heteroatom is again the carboxylic ester group, while another preferred group is aromatic ketone. Large molecules are again preferred over small ones, the molecules preferably containing at least about 8 carbon atoms.

TABLE II

| GROUP B COMPOUNDS WITH ETHER OR HYDROXYL GROUPS | | | |
|---|---|---|---|
| Example Number | Compound | Ratio of H to C=O + N=O + C≡N | Number of C Atoms per Molecule |
| 29 | bis(2-butoxyethyl) phthalate | 15 | 20 |
| 35 | tributyl citrate | 10.7 | 18 |
| 37 | benzyl salicylate | 12 | 14 |
| 43 | ricinoleic acid | 34 | 18 |
| 71 | bis(2-methoxyethyl) phthalate | 9 | 14 |
| 83 | dioctyl-4,7-dioxadecandioate | 23 | 24 |
| 84 | o-hydroxyacetophenone | 8 | 8 |
| 85 | castor oil | 34.7 | 57 |

Group B substances also include nonionic fatty acid derivatives wherein the fatty chain is functionalized with an oxygen-containing function. Preferred oxygen-containing functions are hydroxyl and oxyalkylated hydroxyl (85, 86, 87, and 88). A less preferred oxygen-containing function is epoxide (89 and 90) which tends to hydrolyze and indeed may have partially done so in the samples tested.

Group B substances also include poly(oxypropylene) and poly(oxybutylene) derivatives (91–95). The lowest molecular weight compound in examples 91–95 is believed to have a molecular weight of about 400; molecular weights exceeding about 300 give best results, those exceeding about 400 being preferred for poly(oxypropylene) and poly(oxybutylene) derivatives.

Group B substances also include poly(oxyalkylated) compounds with at least about 9 aliphatic carbon atoms in a hydrophobic portion. In examples 87, 88, 96, 97, and 98 the chains of methylene groups from appropriate hydrophobic portions. In the examples where oxyethylene is the oxyalkyl group, the weight fraction of the molecule which ix oxyethylene varies from about 20 to about 65, which range is the preferred one for oxyethylene compounds. Preferred oxyethylene compounds are fatty acid derivatives, alkylphenoxy compounds, and poly(oxypropylene) adducts.

Group B substances also include esters with from about 4 to about 12 hydrogen atoms per ester group and at least about 6 carbon atoms per molecule. Carboxylic esters in that category have been discussed above, but esters which are not carboxylic can also be Group B compounds. Examples are 44, 45, and 46. Triaryl phosphates are preferred to phosphites or aliphatic phosphates since they tend to be more stable to hydrolysis.

Group C substances include ethers, alcohols, and amines wherein the ratio of carbon atoms to the total number of oxygen and nitrogen atoms is in the range from about 1 to about 3. Representative compounds selected from the examples are listed in Table III.

Preferred Group C compounds are alcohols. Of the alcohols, preferred are polyhydric alcohols with ratios of carbon to oxygen and nitrogen from about 1.5 to about 3. Polyhydric alcohols are compounds with more than one hydroxyl group per molecule. Also preferred are amino alcohols with ratios 1.5–3. Preferred are alcohols with no other functional groups except for ether and amino.

Examples of Group C compounds wherein the only functional group is ether are 110 and 117. Examples wherein the only functional group is amino are 123 and 124. When the only functional group is ether or amino, the ratio of carbon to oxygen and nitrogen should preferably not be above about 2.

Hydroxyl groups are highly hydrophilic, while amino and ether groups are less so. Hydrophilic character is in general decreased by increasing the ratio of carbon to oxygen and nitrogen.

When the Group B compound contains a hydroxyl, the Group C compound must in general be highly hydrophilic to be immiscible. Thus polyhydric alcohols in that case are preferred. When the Group B compound also contains a number of ether oxygens, Group C compounds with ratios of carbon to oxygen and nitrogen below 2 are preferred, and this becomes increasingly essential the more ether oxygens in the Group B compound.

When the Group C compound has a ratio of carbon to oxygen and nitrogen above 2, immiscibility with the Group B compound becomes relatively difficult.

TABLE III

GROUP C COMPOUNDS

| Example Number | Compound | Ratio of C to O + N |
|---|---|---|
| 1 | triethylene glycol | 1.5 |
| 2 | dipropylene glycol | 2.0 |
| 99 | 3-methyl-1,5-pentanediol | 3.0 |
| 101 | 1,3-propanediol | 1.5 |
| 103 | polyethylene glycol 300 | 1.8 |
| 105 | 2,3-butanediol | 2.0 |
| 106 | 1,4-butanediol | 2.0 |
| 108 | nitrilotriethanol | 1.5 |
| 109 | 2,2'-thiodiethanol | 2.0 |
| 110 | tetraethylene glycol dimethyl ether | 2.0 |
| 112 | 1,5-pentanediol | 2.5 |
| 114 | ethanol | 2.0 |
| 115 | Pluracol PeP 450 | 2.3 |
| 116 | diacetin | 1.4 |
| 117 | 1,2-dimethoxyethane | 2.0 |
| 120 | propylene glycol | 1.5 |
| 121 | monoethanolamine | 1.0 |
| 122 | diethylene glycol | 1.3 |
| 123 | ethylene diamine | 1.0 |

TABLE III-continued

GROUP C COMPOUNDS

| Example Number | Compound | Ratio of C to O + N |
|---|---|---|
| 124 | triethylene tetramine | 1.5 |
| 126 | methanol | 1.0 |
| 127 | 2-methyl-2,4-pentanediol | 3.0 |
| 128 | Pluracol TP-740 | 2.8 |

Again in this case high hydrophilicity is desired for immiscibility and again polyhydric alcohols are preferred. Large molecules for the Group B compound are preferred since large molecules are generally more immiscible than small ones. Group B compounds with a relatively low ratio of oxygen to carbon are preferred to minimize hydrogen bonding between the Group C hydroxyls and the Group B oxygens, which promotes solubility.

By following the above guidelines, it may be seen how Pluracol TP740 can form four phases as a Group B compound in one set of conditions (94) and as a Group C compound in another (128). In the latter example, pure water was chosen as the Group D compound to maximize the amount of water dissolved in layer C to maximize its immiscibility with layer B.

Very rarely does any one compound have the potential for acting as a member of more than one Group, and when this is possible the other components of the system must obviously be selected judiciously since compounds closely resembling others are unlikely to be immiscible. In general, in selecting a four-component, four-phase system, it is preferred that each component differ structurally from the others in a major way.

Group D substances include all aqueous solutions. Since pure water can be used to form layer D (128), it is obvious that dilute aqueous solutions of almost anything would serve equally.

In most cases, relatively concentrated aqueous solutions are preferred since compatibility with Group C substances can be decreased in that way. A much wider range of Group C substances can be used with concentrated potassium carbonate solutions, for instance, than can be used with pure water. Some preferred types of solutes can be found in examples 129–150.

The concentration of water can range from 100% down to almost nothing. Corn syrup (150) is about 80% solids (mostly glucose). In example 151, layer D was formed from pure solid sodium thiosulfate pentahydrate crystals. The crystals were combined with the other components and heated to 60° C., whereupon they melted and four liquid layers were formed. Solid sodium thiosulfate pentahydrate contains water, of course, in the form of water of crystallization.

Fluorocarbons are a special class of compounds which are immiscible with almost every other liquid. Fluorocarbons may be added to essentially all of the above four-phase systems which do not contain fluorine to form systems of five liquid phases, as in examples 152–155. Five phase liquid systems are truly rare and unusual. A sixth liquid phase may be added by including a liquid metallic substance such as mercury.

Fluorocarbons are compounds composed of carbon and fluorine, but in the broader sense of the term they may also contain other elements. Fluorocarbons for forming immiscible systems as described herein shouls preferably have a ratio of fluorine atoms to the sum of all other atoms except carbon of at least about 6. Preferably, the fluorocarbon should have at least about five carbon atoms per molecule and preferably no more than one atom which is not carbon or fluorine.

Fluorocarbons appear to be indispensable components of five-phase liquid systems if metallic liquids are avoided, temperatures of around 25° C. are desired, and toxic or corrosive substances are avoided. Fluorocarbons are not preferred as components of systems with fewer phases because fluorocarbons are exensive and because they are difficult to dye or tint.

Systems of three mutually immiscible liquid phases can obviously be formed from Groups A, B, C, and D by omitting one of the Groups. When one of the Groups is omitted, the restrictions on components in the other Groups are broadended considerably. Three phases are much easier to form than four.

If Group A is omitted, molecules of Group B may obviously be modified by adding any hydrocarbon moeity and will still be immiscible with the other components.

If Group B is omitted, all hydrocarbons become members of broadened Group A whether largely aliphatic or not (160), as do halogenated hydrocarbons with at least four carbon atoms per halogen atom (161, 162) and molecules in general with hereto functional groups with at least four carbon atoms per hereto functional group (163). For broadended Group C, the maximum ratio of carbon to ether oxygen plus hydroxyl oxygen plus amino nitrogen is at least about 9 (164–168).

If Group C is omitted, nearly all oxyalkylated compounds, including oxypropylated and oxybutylated derivatives, are members of broadended Group B (169–171).

If systems of three liquid phases from broadened Groups A, B, C, and D are desired for visual display, then it is preferred not to have a member of Group A and a member of Group B simultaneously present because it is difficult to find a dye with a high solubility in the A layer and a low solubility in the B layer. Thus it is hard to avoid the same dye being present to a significant extent in both the A and B layers, making it difficult to dye each layer a different, pure, bright color.

Among the most oil soluble and least hydrophilic of commercially available dyes are dyes such as Oil Orange (172–178), which should be among the best of available dyes for maximizing the color in layer A while minimizing it in other layers. Yet as shown in examples 172–178, even this dye tends to prefer layer B to layer A. When the same colored paraffin oil was mixed instead with 2-butanol (Group C) and water, the color was almost entirely in the A layer, although a little could be seen in the C layer as well. Thus for three-phase systems with bold, contrasting colors, Group A and B should preferably not be copresent.

In similar fashion, if any other two layers are very similarly structurally to each other, as for instance two highly hydroxylic layers, then problems arise in dyeing them two different colors. This is another reason why the principal components of each layer should preferably differ structurally from principal components of all other layers in a major way. The guidelines provided herein make possible selection of a wide range of systems which meet this criterion.

Essentially all three phase liquid systems which are composed of members of broadened Groups A, B, C, and D and which do not contain fluorine compounds can be converted to four phase liquid systems by addition of fluorocarbons (156–159).

The components selected for liquid systems should preferably be chemically stable under the conditions of use. In particular, the components should preferably not be readily hydrolyzed. Although four phases were observed in examples 33, 44, and 154 shortly after shaking, upon standing a few days only three phases remained, presumably because chemical reaction had occurred. Most preferred are compositions which remain essentially unchanged for at least a year.

Preferably, no liquid phase should be toxic as defined in the Code of Federal Regulations, Title 16, part 1500. As applied to these compositions, the most important criterion to be met is that no lquid phase should produce death within 14 days in half or more of a group of white rats when a single dose less than 5 g per kg of body weight is administered orally; i.e., probable lethal dose should be higher than 5 g/kg.

Preferably, no liquid phase should be flammable, and more preferably, none should be combustible as defined in the Code of Federal Regulations, Title 16, part 1500. Flammable substances as defined have open cup flash points lower than 80° F. Combustible substance open cup flash points are lower than 150° F.

If one of the phases is toxic, flammable, or combustible, labeling as a hazardous substance might be required by federal regulation, and use as a child's toy might be prohibited. One of the principal uses contemplated for the present invention is in children's toys.

Use of the guidelines elucidated herein for selection of chemical substances together with toxicological and flammability reference material makes possible the selection of hitherto unknown multiphase compositions which are not toxic, not flammable, and not combustible and are suitable for use in children's toys.

Preferably, no liquid phases should be composed primarily of substances classified as hazardous by the U.S. Dept. of Transportation. Preferably also no components should be required to bear special labeling by government regulation, as for instance by regoluations under the Federal Hazardous Substances Act. Examples of such not-preferred components are ethylene glycol, diethylene glycol, ethylene diamine, diethylene triamine, and petroleum distillates.

Many liquid display devices, such as those described in U.S. Pat. No. 3,613,264, 4,034,493, and 4,057,921, are preferably made of acrylic plastic. Acrylic plastics tend to be attacked by compounds which contain doubly bonded oxygen or triply bonded nitrogen atoms.

By adding a sufficient number of aliphatic carbon atoms to such a molecule, the corrosive effects can be minimized. In general, molecules do not attack most thermoplastics significantly if the ratio of aliphatic carbon atoms to the total number of hetero functional groups is at least 10.

For example, a strip of Rohm and Haas Plexiglass® poly(methyl methacrylate) $1/16 \times \frac{1}{4} \times 1$ inches was placed vertically in a vial, covered to $\frac{3}{4}$ of its depth with solvent, and left overnight at 115° C. With dimethyl phthalate, the strip dissolved. With di(2-ethylhexyl) phthalate (8 aliphatic carbons per hetero functional group) and castor oil (8.5 aliphatic carbons per hetero functional group) it was largely unchanged but there was a mark distinctly visible at the former solvent-air interface. With di(2-ethylhexyl) adipate (10 aliphatic carbons per hetero functional group) no marks were visible at all.

By selection from among Groups A, B, C, and D of compounds which either lack doubly bonded oxygen and triply bonded nitrogen or else contain at least 10 aliphatic carbon atoms for each hetero functional group, systems may be created wherein corrosion problems are avoided.

Display devices made of poly(methyl methacrylate) containing two immiscible liquids are currently being sold commercially. The present invention makes possible three- and four-phase liquid systems which could be used in those same devices and are not toxic, not combustible, and relatively inexpensive and nonvolatile.

If a liquid layer formed according to the principles above is not inherently colored, a dye or other coloring matter should preferably be added to form a colored liquid layer. Preferably, coloring agents should be chosen so that each layer is a different color and the combination of all layers taken together is aesthetically agreeable. Pleasing combinations can also be created when some layers are colored and others are not.

In addition to dyes, small quantities of other materials may be added to achieve various purposes, such as stabilizing or destabilizing emulsions, increasing or decreasing viscosity of density, improving component stability, or modifying solubility properties to control the ratio of concentration of dye in two layers. Minor amounts of various materials may be present as impurities. When a phase is said to be "composed primarily" of a class of substances, it should be undertood that minor amounts of other materials may also be present, and that all materials which are major constituents of any of the other liquid phases will be minor constituents of every phase in equilibrium with them. In all cases, however, a phase composed primarily of something must contain a minimum of 50% by weight of that material.

Preferably, all liquids are transparent so that lines, shapes, bubbles, and colors may be seen through them. If the liquids are translucent or opaque, some of the unique visual effects created by overlapping, interpenetrating, or suspended liquids become obscured or invisible, as do other effects depending on light shining through the liquids.

The visual effects observed depend upon the geometry and transparency of the container and the color, viscosity, density, transparency, index of refraction, and surface tension of the liquids. Preferably, the densities of the liquids are sufficiently different that emulsions separate by gravity reasonably rapidly.

This invention contemplates use of liquid compositions in display devices which depend on movement of a plurality of mutually immiscible liquids. Often the movement is vigorous, as in most of the prior art examples cited above. It can also be very slow. Sometimes the devices are designed to sit around as decorative objects in which most of the time no motion is apparent. In all cases, however, the devices depend in part for their effect upon the fact that under certain conditions the liquids can be observed to move. Liquids which have relatively low viscosity and therefore move relatively rapidly are preferred.

The compositions of multiple, mutually immiscible liquid phases of this invention can be combined whenever desired with gas or solid phases, or with additional immiscible liquid phases such as mercury. They can be confined in any sort of container or apparatus with which they are chemically compatible, including containers described in U.S. patents listed above.

One embodiment of this invention in a display device is given in Example 179, wherein a typical composition of colored liquids is confined within a container the principal walls of which are two substantially parallel, transparent sheets. When this device is moved so as to induce movement in the liquids, such as for instance by tilting it, interesting and amusing shapes, colors, and patterns can be obtained. Examples of different display devices embodying liquid systems of the present invention are Examples 180 and 181.

The most preferred embodiments, however, are Examples 182 and 184, which are particularly preferred because the walls are flexible, transparent sheets which are substantially parallel. By making the walls flexible, I have discovered that far more interesting visual effects can be generated than when they are rigid. Flexibility also adds tactile interest.

So far as is known, no display device containing a plurality of liquids in sheet-like form has been designed to be flexible. All, such as those described in U.S. Pat. No. 4,034,493 and 4,057,921, depend upon gravity flow to generate liquid movement. Although gravity flow may also be a means of inducing liquid movement in this preferred embodiment, the primary means is by deformation of the sheet-like walls.

With a flexible device, patterns and movements of color can be created and moved around in a way that must be seen to be appreciated. Multiple colors overlap, change, blend, and flow. Many of these effects cannot be created merely by gravity flow, or by shaking a rigid device, nor could the magnitude of their aesthetic impact be anticipated by knowing that liquids confined behind flexible walls can be made to move.

As the changing colors stream and drift, coalesce and divide, emulsify and regroup, visual effects are created which are not obtainable with known devices. For example, by picking up the device and exerting different amounts of pressure in various locations using ones fingers, one can force the walls together at any of a wide range of variable locations and in that way create a temporary channel separating but connecting two reservoirs of colored liquids; and then by adjusting the finger forces on the container one can cause blobs of colored liquids to stream through the channel, maintaining their own original color but elongating their shapes in a rapidly flowing multicolored river flowing from one reservoir to the other. When all the finger forces are removed, the container will preferably spontaneously revert to its original sheet-like form.

The blobs in the reservoirs flow into the rivers forming tongues, bands, and ribbons of the same colors as in the blobs, the widths, lengths, and speeds of flow being adjustable at will be alterations in finger pressure, creating intriguing effects not obtainable with known devices.

In the preferred form, the device should be small enough to be picked up and held by one hand. The positions of the liquids should undergo pronounced changes when the shape of the walls is altered by finger pressure. When one picks up such a device, one tends naturally to poke, prod, or deform it, and the resulting changes in colors and patterns stimulate one to continue.

The walls should be sufficiently flexible that when the device is lying flat an air bubble or a suspended liquid globule can be chased around from place to place by pushing on the wall with ones fingertips. More preferably, bubbles and globules of moderate size should be divisible by using finger pressure to indent the wall next to them.

At least one wall should be sufficiently flexible that a 12 inch length can be bent 180° by hand with no cracks or stress marks. More preferably, a 3 inch length can be bent 180°. Preferably, the bent sheet should return spontaneously more or less to its original shape when the pressure is released.

At present, the only wall materials known which are low in cost and easy to fabricate and have good optical clarity, toughness, durability, flexibility, and compatibility with suitable three-phase systems are poly(vinyl chloride), polycarbonates, and nitrile resins. Any other transparent, flexible materials with the above desired qualities could also be used.

Some flexibility is desirable, but extreme flexibility is not. When both walls are very thin, for example less than about 0.006 inch with most thermoplastics, the walls become so flexible that the liquids all run down to the lowest part and are less interesting than if they were held more in sheet-like form between less deformable walls. Upon manipulation such thin sheets touch each other over broad areas whenever even gentle pressure is applied, undesirably expelling all the liquid from that region. In contrast, gentle pressure on thicker sheets tends more to leave moving liquid layers between the sheets, resulting in greater visual interest.

Preferably, the walls should be flexible enough that it should be possible at most points to force the walls temporarily together using vigorous finger pressure, but preferably they should be stiff enough that they tend to maintain a layer of liquid between them when subjected only to mild forces such as gravity or gentle touches. For best results, wall thicknesses should generally be in the range from about 0.006 to about 0.06 inch.

Preferably, the walls should not be so thin as to form a shapeless bag, but rather the walls should preferably tend to maintain a more or less parallel relationship to each other, with the liquid confined in more or less sheet-like form between them. Preferably, the walls should be sufficiently stiff that a completed device 5 inches long can maintain a more or less horizontal position when only one end of the device is held. When the device is held horizontally at only one end, the angle formed by projecting the plane of one end of the device through the projection of the plane of the other end should preferably be less than 40°.

A wall need not be flexible in every part, but only over a significant fraction of its area. A wall need not be transparent in every part, but only sufficiently transparent in some parts that the liquids may be clearly seen. However, best results are obtained when both walls are uniformly transparent and uniformly flexible. Such an arrangement allows illumination from behind, which usually reveals patterns and colors with maximum effect. It also allows an observer to look through the device and view various backgrounds through the changing patterns of colored liquids.

The word transparent is meant to include everything which transmits rays of light, including materials which are translucent and any which are sufficiently non-opaque that colors may be perceived through them. Optical clarity is desirable, however. Translucent materials ar less preferred than materials of high optical clarity.

The two substantially parallel walls which form the device may be connected together to form a liquid-tight seal in any convenient manner. For example, two sheets could be heat sealed together, or glued, or solvent bonded, or sonically welded, or bonded by other methods known in the art of plastics fabrication.

In this preferred embodiment, the walls will not be parallel at all times since they are deformable. They must, however, be capable of being formed into at least one mode wherein substantial portions of the walls are more or less parallel. A plastic pouch formed by heat sealing two plastic sheets together is a preferred container. Even if when filled its sides might bulge outward or contain irregularities, they would still be considered substantially parallel.

The liquids should preferably be readily visible. Colored liquids are preferred, preferably strongly colored so that even in thin layers they are readily visible. Strongly colored liquids can give striking patterns with average thicknesses of only about 0.005 inch, for example.

Optimum average liquid thickness should probably not exceed about 0.2 inch. If the liquid thickness is great, specific patterns tend to be lost in a complex jumble or obscured by thick colored layers. Many interesting patterns sometimes cannot be formed at all, such as those resulting when liquid trapped in one part of a deformed pouch streams out to another area between closely spaced walls.

By following the examples and the reasoning given above, a wide range of liquid systems suitable for use in Example 184 can be developed. In contrast, all the hitherto known three-phase systems which are dyeable with conventional dyes and are suitable for use in display devices (i.e. the ones in U.S. Pat. No. 4,085,533) attack my most preferred thermoplastics, as shown in the following experiment.

All the nonfluorinated three-phase systems taught in U.S. Pat. No. 4,085,533 include one of the following or its close relative: (i) dibutoxyethylphthalate, (ii) propanediol carbonate, (iii) ethanediol monophenyl ether, (iv) tetrahydrothiophen-1,1-dioxide, and (v) tri(2-chloroethyl) orthophosphate. Separate vials containing one strip of plastic sheet were partly filled with one of each of compounds i–v and placed in an oven at 85° C. for 30 min, then cooled. Compounds i, ii, iv, and v all partly dissolved unplasticized poly(vinyl chloride), while iii swelled poly(vinyl chloride), greatly diminishing its clarity and greatly increasing its flexibility, both of which would be undesirable. All five compounds swelled Lexan ® and turned it white. Compounds ii, iv, and v marred and partly dissolved Barex ®, while i and iii caused Barex to curl up and greatly stiffen.

Extrapolating to slightly more general chemical classes, it is clear tht tetrahydrothiophen-1,1-dioxide, ethanediol monophenyl ether, esters of carbonic acid, esters of phthalic acid, esters with chemically bound phosphorus, and esters with chemically bound halogen should preferably be avoided, at least with such plastics as Barex, Lexan, and poly(vinyl chloride).

To be practical, the liquid systems must be compatible with the plastic of the walls. I have discovered unique three-phase systems which do not attack preferred plastics. The thermoplastic container can be regarded as a separate phase which must be immiscible with all the others. My preferred three-phase systems are my four-phase systems wherein the thermoplastic substitutes for Group B and the three low viscosity phases are selected from Groups A, C, and D.

Compounds i, ii, iv, and v are all members of Group B containing doubly bonded oxygen. It is well known that such molecules tend to make good plasticizers for resins such as poly(vinyl chloride), and might therefore by expected to attack it. The aromatic multiple bonds in iii tend to have a plasticizing action resembling the more potent doubly bonded oxygen compounds of Group B. As noted above, aromatics with polar groups tend to have solubility characteristics which make them particularly well suited to Group B. It is clear that compounds with multiple bonds should preferably be avoided in selecting three-phase systems to be compatible with the most preferred thermoplastics.

In contrast to compounds i–v, QO Polymeg 650 ® (Example 168), Pluracol TP740 ® (Example 128), Pluronic L-44 ® (Example 177), and 1,5-pentanediol (Examples 112, 119, and 151), all non-aromatic alcohols which are members of Group C, had no effect at 85° C. for 30 min on the stiffness or clarity or the appearance of the smooth, even surface of poly(vinyl chloride) or Lexan and had only a minor effect on Barex, which curled and stiffened relatively slightly. Since members of Groups A and D will in general not have adverse effects either, this invention provides three-phase systems compatible with preferred thermoplastics and dyeable with conventional dyes.

Lexan is a member of a class of resins generally known as polycarbonate resins. Barex is a type of nitrile resin. The poly(vinyl chloride) sheet used was believed to be a homopolymer, but when generic reference is made herein to "poly(vinyl chloride)", the term should be understood in include both homopolymers and copolymers of vinyl chloride.

EXAMPLES

The following examples serve only to illustrate the invention and not to limit its scope.

The following trade names designate materials with the following compositions sold by the companies listed.

| Trade Name | Composition | Company |
|---|---|---|
| 510 Fluid ® | phenyl methyl polysiloxane | Dow Corning |
| R23 Silicone Resin ® | unspecified polysiloxane | Union Carbide |
| Paraplex G50 ® | a polyester plasticizer | Rohm & Haas |
| FS 1265 Fluid ® | a fluorosilicone fluid | Dow Corning |
| 200 Fluid ® | dimethyl polysiloxane | Dow Corning |
| Suniso 4G ® | an inhibited refrigeration oil | Sun Oil |
| RPM Handy Oil ® | a general purpose lubricating oil | Chevron U.S.A. |
| Crisco Oil ® | partially hydrogenated soybean oil | Procter & Gamble |
| Paraplex G41 ® | a polyester plasticizer | Rohm & Haas |
| Surfactol 318 ® | ethoxylated castor oil, 5 moles/mole | Baker Castor Oil |
| Surfactol 365 ® | ethoxylated castor oil, 40 moles/mole | Baker Castor Oil |
| Estynox 308 ® | glycerol tri(epoxyacetoxystearate) | Baker Castor Oil |
| Vikoflex 7170 ® | epoxidized soybean oil | Viking Chemical |
| QO Polymeg 650 ® | polytetramethylene ether glycol | Quaker Oats |
| Polypropylene Glycol 425 ® | poly(oxypropylene) glycol | Union Carbide |
| Pluronic L-44 ® | polyoxyethylated polyoxypropylene | BASF Wyandotte |
| Pluracol TP740 ® | poly(oxypropylene) adduct of trimethylol propane | BASF Wyandotte |
| Pluracol GP3030 ® | poly(oxypropylene) adduct of glycerol | BASF Wyandotte |
| Igepal CO530 ® | nonylphenoxy pentaoxyethylene ethanol | GAF |
| Igepal CO210 ® | nonylphenoxyethanol + nonylphenoxyethoxyethanol | GAF |
| Igepal DM710 ® | dialkylphenoxy poly(oxyethylene) ethanol | GAF |
| Pluracol PeP450 ® | poly(oxypropylene) adduct of pentaerythritol | BASF Wyandotte |
| Ardamine PH ® | hydrolyzed yeast extract | Yeast Products |
| Fluorinert FC43 ® | perfluorotributylamine | 3M |
| Igepal CO730 ® | nonylphenoxy tetradecaoxy ethanol | GAF |
| Methocel HG ® | hydroxypropyl methyl cellulose | Dow |

EXAMPLES 1–151

In the following examples, about one mL of the Group A substance in the left-hand column was poured into a vial with about one mL of the Group B substance in the next column, about one mL of the Group C substance in the next column, and about one mL of the Group D substance in the right hand column. Volumes were only approximate. The vial was shaken thoroughly and allowed to stand, whereupon four liquid layers separated. Ratios of organic materials in these examples are by volume, while percentage compositions are by weight. Where percentages are stated for Group D, the balance was water.

| Group A | Group B | Group C | Group D |
|---|---|---|---|
| 1. 510 Fluid ® | dimethyl phthalate | triethylene glycol | 50% potassium carbonate |
| 2. R23 Silicone Resin ® | Paraplex G50 ® | dipropylene glycol | " |
| 3. FS 1265 Fluid ® | " | " | " |
| 4. hexamethyl disiloxane | " | " | " |
| 5. 200 Fluid ® | " | " | " |
| 6. heptane | dimethyl phthalate | 3/1=dipropylene glycol/propylene glycol | 27% ammonium sulfate |
| 7. hexadecane | " | 3/1=dipropylene glycol/propylene glycol | " |
| 8. 1-decene | " | 3/1=dipropylene glycol/propylene glycol | " |
| 9. alpha-pinene | " | 3/1=dipropylene glycol/propylene glycol | " |

-continued

| Group A | Group B | Group C | Group D |
|---|---|---|---|
| 10. polybutene | " | 3/1=dipropylene glycol/propylene glycol | " |
| 11. dicyclopentadiene | " | 3/1=dipropylene glycol/propylene glycol | " |
| 12. kerosene | " | 3/1=dipropylene glycol/propylene glycol | " |
| 13. Suniso 4G ® | " | 3/1=dipropylene glycol/propylene glycol | " |
| 14. RPM Handy Oil ® | " | 3/1=dipropylene glycol/propylene glycol | " |
| 15. 3-phenyldodecane | " | 3/1=dipropylene glycol/propylene glycol | " |
| 16. 1-bromotetradecane | " | 3/1=dipropylene glycol/propylene glycol | " |
| 17. safflower oil | " | 3/1=dipropylene glycol/propylene glycol | " |
| 18. Crisco Oil ® | " | 3/1=dipropylene glycol/propylene glycol | " |
| 19. n-decyl oleate | " | 3/1=dipropylene glycol/propylene glycol | " |
| 20. butyl stearate | " | triethylene glycol | 50% potassium carbonate |
| 21. tetradecanethiol | " | " | " |
| 22. trihexylamine | " | " | " |
| 23. ditridecyl thiodiglycolate | Paraplex G50 ® | dipropylene glycol | " |
| 24. 1-chlorododecane | " | " | " |
| 25. bis(2-ethylhexyl) sebaccate | " | " | " |
| 26. C-9 monoalkylbenzene | " | " | " |
| 27. paraffin oil | diethyl phthalate | dipropylene glycol | 27% ammonium sulfate |
| 28. " | diallyl phthalate | " | " |
| 29. " | bis(2-butoxyethyl) phthalate | " | " |
| 30. " | diethyl maleate | " | " |
| 31. " | dibutyl maleate | " | " |
| 32. " | diethyl fumarate | " | " |
| 33. " | diethyl oxalate | " | " |
| 34. " | tripropionin | " | " |
| 35. " | tributyl citrate | " | " |
| 36. " | ethyl benzoylacetate | " | " |
| 37. " | benzyl salicylate | " | " |
| 38. " | 1:1=dibutyl adipate: diethyl succinate | " | " |
| 39. " | 1:1=dibutyl phthalate:diethyl succinate | " | " |
| 40. " | methyl o-chlorobenzoate | " | " |
| 41. " | m-phenylene diacetate | " | " |
| 42. " | pentaerythritol tetra(3-mercaptopropionate) | " | " |
| 43. " | ricinoleic acid | " | " |
| 44. " | triphenyl phosphite | " | " |
| 45. " | tricresyl phosphate | " | " |
| 46. " | tris(2,3-dichloropropyl) phosphate | " | " |
| 47. " | o-chlorobenzaldehyde | " | " |
| 48. " | 1-acetylnaphthalene | " | " |
| 49. " | dibenzyl ketone | " | " |
| 50. " | o-tolunitrile | " | " |
| 51. " | phenylacetonitrile | " | " |
| 52. " | 1-nitropropane | " | " |
| 53. " | 2-nitropropane | " | " |
| 54. " | nitrobenzene | " | " |
| 55. " | o-nitrotoluene | " | " |
| 56. " | dimethyl phthalate | 3:1=dipropylene glycol: propylene glycol | " |
| 57. " | diethyl phthalate | 3:1=dipropylene glycol: | " |

-continued

| Group A | Group B | Group C | Group D |
|---|---|---|---|
| 58. " | diethyl adipate | propylene glycol 3:1=dipropylene glycol: | " |
| 59. " | diethyl fumarate | propylene glycol 3:1=dipropylene glycol: | " |
| 60. " | diethyl oxalate | propylene glycol 3:1=dipropylene glycol: | " |
| 61. " | o-chlorobenzaldehyde | propylene glycol 3:1=dipropylene glycol: | " |
| 62. " | benzonitrile | propylene glycol 3:1=dipropylene glycol: | " |
| 63. " | o-tolunitrile | propylene glycol 3:1=dipropylene glycol: | " |
| 64. " | 4-chlorobutyronitrile | propylene glycol 3:1=dipropylene glycol: | " |
| 65. " | ethyl 2-cyanopropionate | propylene glycol 3:1=dipropylene glycol: | " |
| 66. " | nitroethane | propylene glycol 3:1=dipropylene glycol: | " |
| 67. " | 1-nitropropane | propylene glycol 3:1=dipropylene glycol: | " |
| 68. " | 2-nitropropane | propylene glycol 3:1=dipropylene glycol: | " |
| 69. " | nitrobenzene | propylene glycol 3:1=dipropylene glycol: | " |
| 70. " | butyl benzyl phthalate | propylene glycol 3:1=dipropylene glycol: | " |
| 71. " | bis(2-methoxyethyl) phthalate | propylene glycol 3:1=dipropylene glycol: | " |
| 72. " | benzyl benzoate | propylene glycol triethylene glycol | 50% potassium carbonate |
| 73. " | benzyl salicylate | " | " |
| 74. " | dimethyl glutarate | " | " |
| 75. " | dimethyl succinate | " | " |
| 76. " | diethyl malonate | " | " |
| 77. " | dimethyl adipate | " | " |
| 78. " | diethyl succinate | " | " |
| 79. " | dibutyl maleate | " | " |
| 80. " | Paraplex G41 ® | " | " |
| 81. " | Paraplex G50 ® | " | " |
| 82. " | polyester from adipic acid and diethylene glycol | " | " |
| 83. " | dioctyl-4,7-dioxadecandioate | " | " |
| 84. " | o-hydroxyacetophenone | " | " |
| 85. " | castor oil | " | " |
| 86. " | glycerol monoricinoleate | " | " |
| 87. " | Surfactol 318 ® | " | " |
| 88. " | Surfactol 365 ® | " | " |
| 89. " | Estynox 308 ® | " | " |
| 90. " | Vikoflex 7170 ® | " | " |
| 91. " | QO Polymeg 650 ® | " | " |
| 92. " | Polypropylene Glycol 425 ® | " | " |
| 93. " | Pluronic L-44 ® | " | " |
| 94. " | Pluracol TP740 ® | " | " |
| 95. " | Pluracol GP3030 ® | " | " |
| 96. " | Igepal CO530 ® | " | " |
| 97. " | Igepal CO210 ® | " | " |
| 98. " | Igepal DM710 ® | " | " |
| 99. " | dibutyl phthalate | 3-methyl-1,5-pentanediol | " |
| 100. " | Paraplex G50 ® | dipropylene glycol | " |
| 101. " | dimethyl phthalate | 1,3-propanediol | " |

-continued

| | Group A | Group B | Group C | Group D |
|---|---|---|---|---|
| 102. | " | " | 1:1=2-methyl-2,4-pentanediol:diethylene glycol | " |
| 103. | " | 1:1=diethyl phthalate:dibutyl phthalate | polyethylene glycol 300 | " |
| 104. | " | 1:1=diethyl phthalate:dibutyl phthalate | 1,3-propanediol | " |
| 105. | " | 1:1=diethyl phthalate:dibutyl phthalate | 2,3-butanediol | " |
| 106. | " | 1:1=diethyl phthalate:dibutyl phthalate | 1,4-butanediol | " |
| 107. | " | 1:1=diethyl phthalate:dibutyl phthalate | triethylene glycol | " |
| 108. | " | 1:1=diethyl phthalate:dibutyl phthalate | nitrilotriethanol | " |
| 109. | " | 1:1=diethyl phthalate:dibutyl phthalate | 2,2'-thiodiethanol | " |
| 110. | " | 1:1=diethyl phthalate:dibutyl phthalate | tetraethylene glycol dimethyl ether | 27% ammonium sulfate |
| 111. | " | 1:1=diethyl phthalate:dibutyl phthalate | 3-methyl-1,5-pentanediol | " |
| 112. | " | 1:1=diethyl phthalate:dibutyl phthalate | 1,5-pentanediol | " |
| 113. | " | 1:1=diethyl phthalate:dibutyl phthalate | dipropylene glycol | " |
| 114. | " | 1:1=diethyl phthalate:dibutyl phthalate | ethanol | " |
| 115. | " | 1:1=diethyl phthalate:dibutyl phthalate | Pluracol PeP450 ® | " |
| 116. | " | castor oil | diacetin | " |
| 117. | " | " | 1,2-dimethoxyethane | " |
| 118. | " | " | 3-methyl-1,5-pentanediol | " |
| 119. | " | " | 1,5-pentanediol | " |
| 120. | " | dimethyl phthalate | propylene glycol | 60% dipostassium hydrogen phosphate |
| 121. | " | " | monoethanolamine | 60% dipotassium hydrogen phosphate |
| 122. | " | " | diethylene glycol | 60% dipotassium hydrogen phosphate |
| 123. | " | " | ethylene diamine | 60% dipotassium hydrogen phosphate |
| 124. | " | " | triethylene tetramine | 60% dipotassium hydrogen phosphate |
| 125. | Crisco Oil ® | bis(2-methoxyethyl) phthalate | triethylene glycol | 60% dipotassium hydrogen phosphate |
| 126. | paraffin oil | Paraplex G50 ® | methanol | 60% dipotassium hydrogen phosphate |
| 127. | " | " | 2-methyl-2,4-pentanediol | 10% sodium chloride |
| 128. | " | " | Pluracol TP740 ® | water |
| 129. | " | diethyl phthalate | 3-methyl-1,5-pentanediol | 10% ammonium sulfate |
| 130. | " | " | " | 10% lithium sulfate |
| 131. | " | " | " | 10% magnesium sulfate |
| 132. | " | " | " | 10% aluminum sulfate |
| 133. | " | " | " | 10% zinc sulfate |
| 134. | " | " | " | 10% cupric sulfate |
| 135. | " | " | " | 10% manganese sulfate |
| 136. | " | " | " | 10% cobalt sulfate |
| 137. | " | " | " | 10% sodium dihydrogen phosphate |
| 138. | " | " | " | 10% tripotassium phosphate |
| 139. | " | " | " | 10% sodium thiosulfate |
| 140. | " | " | " | 10% sodium sulfite |
| 141. | " | " | " | 25% sodium chloride |
| 142. | " | " | " | 10% sodium citrate |
| 143. | " | " | " | 20% ferric ammonium citrate |

-continued

| Group A | Group B | Group C | Group D |
|---|---|---|---|
| 144. " | " | " | 10% sodium tartrate |
| 145. " | " | " | 45% sodium formate |
| 146. " | " | " | 10% glycine |
| 147. " | " | " | 33% Ardamine PH ® |
| 148. " | " | " | 40% sorbitol |
| 149. " | " | " | 50% sucrose |
| 150. " | " | " | corn syrup |
| 151. " | 1:1=diethyl phthalate:dibutyl phthalate | 1,5-pentanediol | 100% sodium thiosulfate pentahydrate at 60° C. |

EXAMPLES 152–159

In the following examples, equal volumes of liquids from Groups A–D as shown below were combined in a vial with a similar volume of a fluorocarbon. The vial was shaken and allowed to stand. The resulting number of layers is shown in the table.

| Group A | Group B | Group C | Group D | Fluorocarbon | No. of Layers |
|---|---|---|---|---|---|
| 152. paraffin oil | dimethyl phthalate | triethylene glycol | 50% potassium carbonate | perfluoro-1-methyldecalin | 5 |
| 153. " | " | " | 50% potassium carbonate | perfluoro-heptene-1 | 5 |
| 154. " | " | " | 50% potassium carbonate | perfluoro-heptyl iodide | 5 |
| 155. " | castor oil | " | 40% dipotassium hydrogen phosphate | Fluorinert FC43 ® | 5 |
| 156. none | " | " | 40% dipotassium hydrogen phosphate | Fluorinert FC43 ® | 4 |
| 157. paraffin oil | none | " | 40% dipotassium hydrogen phosphate | Fluorinert FC43 ® | 4 |
| 158. " | castor oil | none | 40% dipotassium hydrogen phosphate | Fluorinert FC43 ® | 4 |
| 159. " | " | triethylene glycol | none | Fluorinert FC43 ® | 4 |

EXAMPLES 160–171

In the following examples, equal volumes of the liquids listed were shaken in a vial. Upon standing, three liquid layers separated. Liquids were selected to demonstrate how Groups A, B, C, and D can be broadened when only three phases are desired.

| Broadened Group A | Broadened Group B | Broadened Group C | Group D |
|---|---|---|---|
| 160. toluene | — | triethylene glycol | 50% potassium carbonate |
| 161. 1-chlorobutane | — | triethylene glycol | 50% potassium carbonate |
| 162. chlorobenzene | — | triethylene glycol | 50% potassium carbonate |
| 163. ethyl acetate | — | triethylene glycol | 50% potassium carbonate |
| 164. paraffin oil | — | cyclohexanol | water |
| 165. paraffin oil | — | 2-phenyl-2-propanol | " |
| 166. paraffin oil | — | i-amyl alcohol | " |
| 167. paraffin oil | — | aniline | " |
| 168. paraffin oil | — | QO Polymeg 650 ® | " |
| 169. paraffin oil | hexyloxyethoxyethanol | — | " |

-continued

| Broadened Group A | Broadened Group B | Broadened Group C | Group D |
|---|---|---|---|
| 170. paraffin oil | ethoxyethanol | — | 50% potassium carbonate |
| 171. paraffin oil | Igepal CO730 ® | — | 50% potassium carbonate |

EXAMPLES 172–178

A small amount of Oil Orange Liquid from E. I. du Pont de Nemours & Co. was dissolved in paraffin oil. Portions of this solution were shaken with equal volumes of the liquids below. In each case. three liquid layers separated and the intensity of the color in the B layer was at least as great as that in the A (paraffin oil) layer.

| Group B | Group D |
|---|---|
| 172. benzonitrile | water |
| 173. dimethyl maleate | " |
| 174. castor oil | " |
| 175. tricresyl phosphate | " |
| 176. 2-nitropropane | 50% potassium carbonate |
| 177. Pluronic L-44 ® | " |
| 178. Igepal CO530 ® | " |

EXAMPLE 179

Two plates of glass 6 inches square were positioned parallel to each other separated along the edges by 0.1 inch spacers running continuously around the periphery except for one small opening. The edges were sealed with epoxy resin, forming a container with approximate internal dimensions 6×6×0.1 inch.

A composition of four immiscible liquids was prepared by dissolving 2 g of potassium chromate and 20 g of potassium carbonate in 78 g of water and combining 60 mL of the resulting aqueous solution with 40 mL of 1,5-pentanediol, 60 mL of 1-nitropropane, 50 mL of paraffin oil, 24 mg of 1-(4-methylphenylazo)-2-naphthol, and 24 mg of quinizarin. After being shaken vigorously then standing, four layers separated colored gold, orange, maroon, and lemon yellow listed top to bottom. Approximately equal volumes of the four differently colored solutions were injected with a syringe into the glass container through the small opening, filling the container almost completely but leaving a small air space. The opening was then sealed with epoxy and a small plug.

After the epoxy had cured, the device was ready for use. By holding it in various orientations, the four different colors and the air bubble chase each other and intermingle, forming designs and patterns and forming new colors when two colors overlap each other in the line of sight of the observer.

EXAMPLE 180

Into a 2 dram vial was poured 1.4 g of dodecane, 2.2 g of benzonitrile, 1.4 g of triethylene glycol, and 2.8 g of a 50% aqueous solution of potassium carbonate. Upon shaking and standing, four phases separated. A few small crystals of methyl red were added. Upon shaking and standing, the top and bottom layers were colorless, and lower middle layer deep yellow, and the upper middle layer pale yellow.

Upon shaking, the vial acquired a uniform opaque yellow appearance which broke up into sparkling balls of various shades of yellow which began to separate into increasingly well defined bands. Bands were produced not only by each liquid layer, but by the emulsion between any two layers. The emulsion layers shrank to nothing as the single phase layers expanded. The filled vial constituted an amusing and intriguing toy.

If instead of adding methyl red, 0.5 mg of sulforhodamine B, 0.5 mg of HE 500 Fat Blue B (from American Hoechst), and 30 mg of potassium ferricyanide were dissolved in the above liquid mixture, all four layers were colored. The top layer was light blue, the one below deep blue, the one below that fluorescent red, and the bottom yellow. After shaking and standing, a spectrum of hues evolved as the emulsions separated into layers.

EXAMPLE 181

A solution was prepared of 3 g of azobenzene in 200 mL of paraffin oil. This solution had a Saybolt viscosity of 80° at 100° F. Another solution was prepared by adding 1.1 g of Methocel HG® with vigorous stirring to 100 mL of boiling water, cooling the solution, allowing it a stand overnight, adding 15 mg of Methylene Blue and 11 g of sodium acetate trihydrate, and stirring until solution was complete. The resulting aqueous solution had a viscosity similar to that of the paraffin oil, but slightly less.

The two solutions were combined and shaken together vigorously with 100 mL of Pluracol TP740, which had a viscosity somewhat greater than that of the paraffin oil, and with 20 mL of isoamyl alcohol. Upon standing, the mixture separated into three layers, colored yellow, green, and blue from top to bottom.

To a container resembling the specific embodiment described in U.S. Pat. No. 4,034,493, fabricated from two sheets of poly(methyl methacrylate) with spacers and baffles of the same material and with reservoirs at each end, were added equal volumes of the equilibrated green and blue solutions until the bottom reservoir was filled. Then the remainder of the container was filled with equilibrated yellow solution and sealed.

The completed device, instead of giving falling beads of only one color, gives them of two colors in a way which addes considerably to interest in the device.

EXAMPLE 182

A set of immiscible solutions was prepared by dissolving 30 mg of Methylene Blue, 1 g of sodium tetraborate decahydrate, and 11 g of sodium acetate trihydrate in 100 mL of water and combining the resulting solution with 50 mL of isoamyl alcohol, 50 mL of isobutyl alcohol, and 100 mL of a solution of 1.5 wt % of azobenzene in paraffin oil. The resulting mixture was thorougly shaken and then allowed to stand until it had separated completely into three layers. The top layer was green, the middle golden yellow, and the bottom blue.

Two sheets of 7.5 mil Barex 210 sheet were cut into octagons 3.5 inches in diameter. They were heat sealed together along 7 edges. Through the remaining gap was introduced 2 mL of each of the above equilibrated mutually immiscible liquids. The unsealed edge was then heat sealed, confining the three liquids and a small air bubble.

When the above device is horizontal on a white surface after resting undisturbed for a time, blobs of blue, blobs of green, and blobs of yellow are seen. Gentle finger pressure suffices to chase them around or alter their shape. That can be done more readily by picking the device up with both hands. The device may be held in any orientation and squeezed in various ways. By forcing the liquid to flow through relatively narrow channels, interesting streams of color are created. Shapes and forms interpenetrate and overlap each other, dividing and coalescing in intricate and ever varying patterns.

If 70 mg of Oil Red O (from Tricon Colors) is used in the above formulation in place of the azobenzene, the resulting three layers are purple, red, and blue from top to bottom.

EXAMPLE 183

A 70 mil sheet was prepared by hot pressing a calendered mixture of 100 g poly(vinyl chloride) resin, 50 g di-2-ethylhexyl phthalate, 0.3 g stearic acid, 4.0 g Monoplex S-73®, and 1.0 g dibutyl tin di-2-ethylhexanoate. The sheet was cut into two 3×4 inch rectangles which were placed together and heat sealed along 3 edges. The resulting pouch was filled with 3 mL of each of the liquids used in Example 182 except that isoamyl alcohol replaced isobutyl alcohol. After the liquids were confined in the pouch by heat sealing, the device initially had good clarity, flexibility, and stiffness and gave effects resembling those of Example 182. After standing for 24 hours, however, the three original liquid layers had merged to form only two, possibly because plasticizer was leached from the plastic and changed solubility relationships. The device containing two liquids was not nearly so interesting as the device containing three.

EXAMPLE 184

To form an appropriate container from sheets of 20 mil (0.5 mm) unplasticized poly(vinyl chloride) obtained from TAP Plastics, a 30 mil (0.8 mm) Teflon® spacer $2\frac{1}{4}\times7$ inches ($6\times18$ cm) was placed on top of a sheet $3\frac{1}{2}\times5\frac{1}{2}$ inches ($9\times14$ cm) so that their center lines were coincident and about $\frac{1}{2}$ inch (slightly over 1 cm) of plastic was exposed at the end of the Teflon. This exposed portion was to form the bottom of the device. A second sheet like the first was placed on top of the Teflon spacer so that the bottom ends of the plastic sheets coincided.

The bottom and two sides were sealed with a hydraulic press at 250° F. (120° C.). The spacer was withdrawn and the chamber was filled with approximately equal amounts of the three mutually immiscible liquids of Example 182. The top was then sealed as the sides had been.

Effects observed upon manipulating this device resemble those described for Example 182 except that it is stiffer and the walls are not so readily deformable. After standing for one month, this device and that of Example 182 appeared essentially unchanged, establishing that these liquids preserve the integrity of the plastics used.

As the range of embodiments of this invention is wide, and many may appear to be widely different, yet not depart from the spirit and scope thereof, it is to be understood that this invention is not limited to the specific embodiments thereof, except as defined in the appended claims.

I claim:

1. In a display device which depends on the movement of a plurality of mutually immiscible liquids, the combination thereof with a composition comprising at least four mutually immiscible liquids, three of which are composed primarily of organic substances the molecules of which contain at least 3 hydrogen atoms and do not attain fluorine, and the fourth of which comprises water.

2. The combination described in claim 1 wherein the composition comprises in combination:

(A) at least one substance selected from the group consisting of silicone oil and substances with molecules composed largely of aliphatic hydrocarbons portions, (B) at least one substance selected from the group consisting of (1) organic compounds with molecules containing at least one doubly bonded oxygen or triply bonded nitrogen atom and no ether or hydroxyl groups, with the ratio of hydrogen atoms to the total number of doubly bonded oxygen and triply bonded nitrogen atoms being in the range from about 4 to about 14; (2) organic compounds with molecules containing at least one doubly bonded oxygen or triply bonded nitrogen atom, at least one ether or hydroxyl group, and at least about 8 carbon atoms, with the ratio of hydrogen atoms to the total number of doubly bonded oxygen and triply bonded nitrogen atoms being in the range from about 8 to about 35; (3) nonionic fatty acid derivatives wherein the fatty chain is functionalized with an oxygen-containing function; (4) poly(oxypropylene) and poly(oxybutylene) derivatives; (5) poly(oxyalkylated) compounds with at least about 9 aliphatic carbon atoms in a hydrophobic portion; and (6) esters with from about 4 to about 12 hydrogen atoms per ester group and at least about 6 carbon atoms per molecule, (C) at least one substance with molecules containing at least one ether, hydroxyl, or amino group, wherein the ratio of carbon atoms to the total number of oxygen and nitrogen atoms is in the range from about 1 to about 3, and (D) an aqueous solution.

3. The combination described in claim 2 wherein every liquid phase has a flash point higher than 150° F.

4. The combination described in claim 2 wherein the organic compounds with molecules containing at least one doubly bonded oxygen or triply bonded nitrogen atom are selected from the group consisting of aromatic compounds and molecules wherein the total number of doubly bonded oxygen and triply bonded nitrogen atoms is at least two.

5. The combination described in claim 1 comprising in combination:

(A) at least one substance selected from the group consisting of silicone oils, hydrocarbons, fatty acid esters, and molecules with at least about 12 aliphatic carbon atoms for each hetero functional group, (B) at least one substance selected from the group consisting of aromatic carboxylic esters, aliphatic polycarboxylic esters with a ratio of hydrogen atoms to carboxyl groups in the range from about 4 to about 12, aromatic ketones, and triaryl phosphates, (C) at least one substance selected from the group consisting of polyhydric alcohols and amino alcohols with a ratio of carbon atoms to the total number of oxygen and nitrogen atoms in the range from about 1.5 to about 3, and (D) an aqueous solution.

6. The combination described in claim 5 wherein every liquid phase has a flash point higher than 150° F. and a probable lethal dose higher than 5 g/kg, and wherein the device is operable at normal room temperature.

7. The combination described in claim 1 comprising in combination:

(A) at least one substance selected from the group consisting of silicone oils, hydrocarbons, fatty acid esters, and molecules with at least about 12 aliphatic carbon atoms for each hetero functional group, (B) at least on substance selected from the group consisting of (1) nonionic fatty acid derivatives wherein the fatty chain is functionalized with a oxygen-containing function, (2) poly(oxypropylene) and poly(oxybutylene) derivatives, and (3) poly(oxyalkylated) compounds with at least about 9 aliphatic carbon atoms in a hydrophobic portion, (C) at least one substance selected from the group consisting of polyhydric alcohols and amino alcohols with a ratio of carbon atoms to the total number of oxygen and nitrogen atoms in the range from about 1.5 to about 3, and (D) an aqueous solution.

8. The combination described in claim 7 wherein every liquid phase has a flash point higher than 150° F. and a probable lethal dose higher than 5 g/kg, and wherein the device is operable at normal room temperature.

9. The combination described in claim 1 wherein at least four liquids are composed primarily of substances resembling those listed in the examples in the above specification, the majority component of each liquid differing structurally from the majority components of every other liquid.

10. In a display device which depends on the movement of a plurality of mutually immiscible liquids at normal room temperature, the combination thereof with a composition comprising at least three mutually immiscible liquids, (1) each of which contains less than 20% by weight of ionic compounds and is composed primarily of compounds which do not contain fluorine, (2) one of which is composed primarily of substances selected from the group consisting of hydrocarbons, silicone oils, and molecules composed largely of aliphatic hydrocarbon portions with at least four carbon atoms per hetero functional group, (3) one of which is composed primarily of nonaromatic organic compounds the molecules of which contain at least one ether, hydroxyl, or amino group with the ratio of carbon atoms to the total number of ether oxygen, hydroxyl oxygen, and amino nitrogen atoms in the range from about 1.5 to about 4, said molecules being composed only of elements selected from the group consisting of carbon, hydrogen, oxygen, nitrogen, and sulfur, and containing no carbonic acid ester groups, and (4) one of which is composed primarily of substances selected from the group consisting of water and polyhydroxy organic compounds wherein the ratio of hydroxyl groups to carbon atoms is at least about $\frac{2}{3}$.

11. The combination described in claim 10 wherein (a) all liquid phases have a flash point higher than 150° F., (b) one liquid phase is composed of more than 50% by weight of molecules composed largely of aliphatic hydrocarbon portions, wherein molecules containing hetero functional groups contain at least ten carbon atoms per hetero functional group, and (c) one liquid phase is composed of more than 50% by weight of substances selected from the group consisting of polyethers, ether alcohols, and polyhydric alcohols wherein the ratio of carbon atoms to the total number of ether oxygen, hydroxyl oxygen, and amino nitrogen atoms is between 2.0 and 3.6.

12. The combination described in claim 10 wherein all liquid phases have a flash point higher than 150° F.; the group of part (2) consists of hydrocarbons, silicone oils, halogenated hydrocarbons with at least four carbon atoms per halogen atom, and molecules containing only carbon, hydrogen, and oxygen with at least ten aliphatic carbon atoms for each hetero functional group; and the ratio of part (3) is between 2.0 and 3.6.

13. The combination described in claim 10 wherein:

(a) all compounds which constitute more than 50% by weight of any liquid phase are composed of molecules containing only elements selected from the group consisting of carbon, hydrogen, oxygen, nitrogen, and silicon, and (b) one liquid phase is composed of more than 50% by weight of organic hydroxyl compounds.

14. The combination described in claim 12 wherein the group of part (2) consists of hydrocarbons, silicone oils, and fatty acid esters, and wherein all liquid phases have a probable lethal dose higher than 5 g/kg and contain less than 10% by weight of ionic compounds.

15. The combination described in claim 10 wherein all liquid phases are composed of compounds with a probable lethal dose higher than the product of 5 g/kg times the weight fraction of the compound in the phase in which it is most concentrated.

16. A toy comprising transparent walls which confine a system of at least three mutually immiscible liquid phases, (1) each of which contains less than about 20% by weight of ionic compounds and is composed primarily of compounds which do not contain fluorine, (2) one of which is composed primarily of substances selected from the group consisting of hydrocarbons, silicone oils, halogenated hydrocabons with at least four carbon atoms per halogen atom, and molecules with at least ten aliphatic carbon atoms for each hetero functional group, (3) one of which is composed primarily of organic hydroxyl compounds the molecules of which do not contain multiple bonds and do not contain phosphorus, and (4) one of which is composed primarily of substances selected from the group consisting of water and polyhydroxy organic compounds wherein the ratio of hydroxyl groups to carbon atoms is at least about $\frac{2}{3}$.

17. The toy of claim 16 wherein each liquid phase has a probable lethal dose higher than 5 g/kg.

18. The toy of claim 16 wherein each liquid phase has a flash point higher than 150° F. and contains less than 10% by weight of ionic compounds.

19. The toy of claim 18 wherein each compound which constitutes more than 50% of any phase is composed of molecules containing only elements selected from the group consisting of carbon, hydrogen, oxygen, nitrogen, and silicon, and wherein fewer than two phases contain more than 20% by weight of water.

20. A display device comprising at least three mutually immiscible liquid phases composed primarily of water and organic substances the molecules of which do not contain fluorine and do not contain multiple bonds.

21. The device of claim 20 wherein every liquid phase has a flash point higher than 150° F.

22. The device of claim 21 wherein every liquid phase has a probable lethal doese higher than 5 g/kg.

23. A display device comprising three mutually immiscible liquid phases, each dyeable with conventional dyes, sealed within a container the principal walls of which are formed from a transparent thermoplastic selected from the group consisting of poly(vinyl chloride), polycarbonates, and nitrile resins.

24. A display device comprising at least three mutually immiscible liquid phases, (1) one liquid phase composed primarily of substances which do not contain fluorine and are selected from the group consisting of silicone oils, hydrocarbons, and substances the molecules of which are composed largely of aliphatic hydrogen portions, (2) one liquid phase composed primarily of nonaromatic alcohol with a ratio of carbon to oxygen in the range 1.5 to 6.0, and (3) one liquid phase composed primarily of substances selected from the group consisting of water and polyhydroxy organic compounds wherein the ratio of hydroxyl groups to carbon atoms is at least about $\frac{2}{3}$.

25. The device of claim 24 wherein (1) the liquid phases are sealed within a container comprising two substantially parallel, transparent, flexible walls, (2) a 12 inch length of a sheet of the material of which a wall is composed can be bent 180° with no cracks or stress marks and will return spontaneously more or less to its original shape when the pressure is released, (3) the device is sufficiently stiff that when it is held horizontally at only one end, the angle formed by projecting the plane of one end of the device through the projection of the plane of the other end is less than 40°, (4) the device is sufficiently flexible that it is possible at most points to force the walls temporarily together using finger pressure, and (5) the average liquid thickness is less than about 0.2 inch.

26. In a display device which depends on viewing the movement of a plurality of mutually immiscible colored liquids by transmitted light, the combination thereof with at least three mutually immiscible liquid phases sealed within a container the principal walls of which are two substantially parallel, transparent sheets of thermoplastic which are sufficiently flexible that by exerting finger pressure one can (1) create, by forcing the walls together at any of a wide range of locations, a temporary channel connecting two reservoirs of colored liquids, (2) cause blobs of colored liquids to stream through the channel from one reservoir to the other, maintaining their own original color as they go, and (3) restore the container to its original sheet-like form by removing the finger pressure.

27. The device of claim 26 wherein (1) a 12 inch length of a sheet of which a wall is composed can be bent 180° with no cracks or stress marks and will return spontaneously more or less to its original shape when the pressure is released, (2) the device is sufficiently stiff that when it is held horizontally at only one end, the angle formed by projecting the plane or one end through the projection of the plane of the other end is less than 40°, (3) the average liquid thickness is less than about 0.2 inch, (4) the device is small enough to be picked up and held by one hand, and (5) one can look through the device and view various backgrounds through changing patterns of colored liquids.

28. The device of claim 26 wherein none of the liquids is composed principally of tetrahydrothiophene-1,1-dioxide, ethanediol monophenyl ether, esters of carbonic acid, esters of phthalic acid, esters with chemically bound phosphorus, esters with chemically bound halogen, or compounds which contain fluorine.

* * * * *